United States Patent [19]

Boden

[11] 4,409,768

[45] Oct. 18, 1983

[54] PREFABRICATED WALL PANEL

[76] Inventor: Joseph Boden, 341 Timber View Dr., Oak Brook, Ill. 60521

[21] Appl. No.: 239,324

[22] Filed: Mar. 2, 1981

Related U.S. Application Data

[63] Continuation-in-part of Ser. No. 155,488, Jun. 2, 1980, abandoned.

[51] Int. Cl.[3] ..... E04C 2/20

[52] U.S. Cl. ..... 52/309.4; 52/743

[58] Field of Search ..... 52/309.4, 309.8, 309.12, 52/309.9, 309.17, 601, 404, 741, 743, 809

[56] References Cited

U.S. PATENT DOCUMENTS 3,334,464 8/1967 Charles ..... 52/309.9 X

*Primary Examiner*—J. Karl Bell

*Attorney, Agent, or Firm*—McDougall, Hersh & Scott

[57] ABSTRACT

A light-weight rigid foam panel having good insulating properties is held by a metal framework which includes two vertical support members and at least one horizontal support member secured to the top ends of the latter. An inwardly projecting flange along the vertical members aids in securing the foam panel. Preferably the foam panel is molded to the framework. Sheets of material covering the faces of the foam panel facilitates the application of a finishing material such as plaster to the wall panels. A method for manufacturing a wall panel with a molded foam panel is also disclosed.

13 Claims, 8 Drawing Figures

PREFABRICATED WALL PANEL

This application is a continuation-in-part of Ser. No. 155,488 filed June 2, 1980, now abandoned.

BACKGROUND OF THE INVENTION

This invention relates to the field of prefabricated wall panels, and more specifically to light-weight prefabricated panels having a metal frame with a molded foam panel.

Buildings made of prefabricated metal panels have been used in limited applications, such as for warehouse storage. Metal prefabricated panels suffer the primary disadvantage of extremely poor insulating properties. If it is desired to maintain a controlled temperature environment inside a building constructed of metal panels, either large amounts of energy must be utilized to maintain the interior temperature or substantial amounts of insulation must be added to reduce the thermal losses.

The rising costs of labor and materials have made increasingly desirable the use of prefabricated building panels for not only commercial structures but homes. Economies of production line manufacture of prefabricated panels as well as ease of construction site erection would significantly reduce cost of labor. Also, in light of decreasing energy availability, prefabricated building panels having good thermal insulating properties are especially desirable.

Applicant's U.S. Pat. No. 4,236,361, entitled "Prefabricated Building Components", discloses a prefabricated wall panel of foam construction. Steel columns reinforced with concrete are utilized in such panels and require care in handling so as to avoid stressing the concrete sections as would occur if such panel was twisted. Excessive stressing of the concrete columns may crack the concrete used as reinforcement. The present invention provides an improved prefabricated foam panel which does not require concrete reinforcement. A comparable panel constructed in accordance with the present invention is substantially lighter in weight, easier to manufacture, and more economical.

PRIOR ART STATEMENT

Other than applicant's patent referenced above, the closest known structure to applicant's current invention is believed to be U.S. Pat. No. 2,271,929, to W. H. Venzie. This patent discloses room surfacing panels having sound absorbant properties. The panel disclosed therein comprises a metal panel enclosing sound insulating material, a supporting metal lath, and sound absorbing grouting.

U.S. Pat. No. 3,736,715 to Krumwiede discloses a load bearing building panel having a metal frame to which sheets of gypsum board and polystyrene are attached.

Although U.S. Pat. No. 2,257,001 to C. F. Davis is primarily directed to methods for joining like building slabs, this reference does disclose various ways of supporting materials.

The following U.S. Pat. Nos. are cited as generally dealing with devices for prefabricated building construction: 3,927,498 to Benedetti; 4,065,905 to Van Der Lely; 4,071,984 to Larrow.

Applicant also wishes to call attention to a Fiberglas-polyurethane building system, manufactured by Dura-Plex, in which polyurethane is sandwiched between a Fiberglas skin.

SUMMARY OF THE INVENTION

Two vertical support members in parallel spaced relationship have attached to their upper ends a first horizontal support member, and preferably a second horizontal member attached near the bottom ends of the vertical members, thereby defining a frame. The vertical members have an inwardly projecting flange which runs substantially along their longitudinal lengths. The flanges and the respective vertical members may have a cross sectional configuration which defines a channel which allows communication between the channels and the space enclosed by the frame. A foam insulating material is integrally molded to the frame so as to substantially fill the space defined within the frame and the channels. Preferably, a layer of material is bonded to the faces of the panels prior to the setting up of the foam. The purpose of this material is to provide a surface upon which a finishing material, such as plaster, or other suitable materials can be applied.

It is the primary object of the present invention to provide a light-weight prefabricated panel of rigid foam having structural integrity and good thermal insulating properties which is easy to manufacture.

A further object of this invention is to provide a method for manufacturing a panel having the advantages and qualities discussed above.

DETAILED DESCRIPTION

Figure 1:
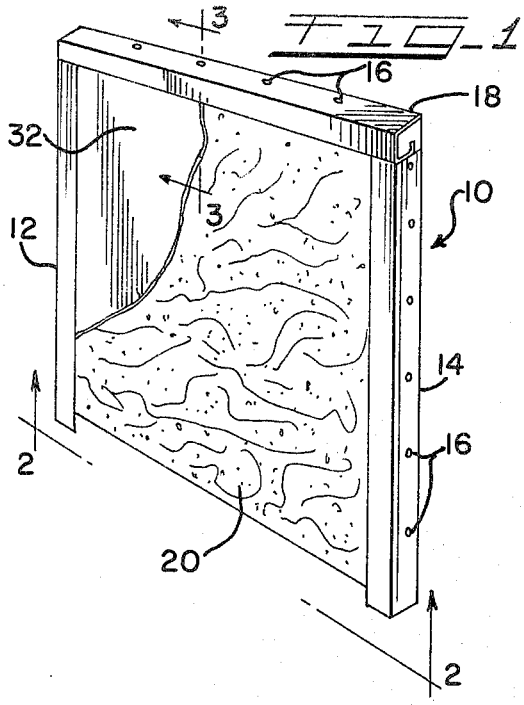
FIG. 1 is a perspective view of one embodiment of a prefabricated foam panel according to the present invention.
Figure 3:
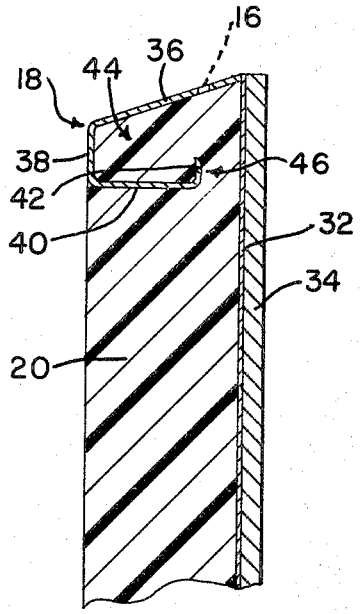
FIG. 3 is a fragmentary cross sectional view taken about line 3—3 in FIG. 1.
Figure 2:
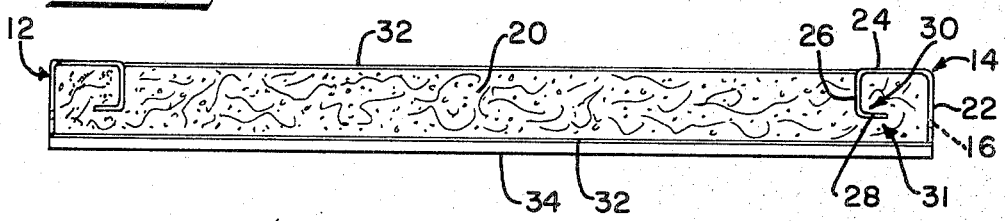
FIG. 2 is a bottom view of such a panel taken about line 2—2 in FIG. 1.

Referring now in particular to the embodiment shown in FIGS. 1, 2 and 3, a prefabricated wall panel designated generally by numeral 10 is shown. Vertical support members 12 and 14 preferably have a channel cross section and are constructed from a sheet of metal, with steel being highly suitable. A horizontal support member 18, preferably having a construction similar to the vertical support members, is welded or otherwise securely attached to like disposed ends of members 12 and 14 thereby forming a planar frame. Apertures 16 in the vertical support members are utilized to join panels of similar construction when placed in side-by-side relationship by bolting adjacent panels together. Similarly, apertures 16 in horizontal support member 18 enables the top of the panel to be joined to a roof or other structure.

A panel 20 as shown in FIG. 1 is made of a rigid light-weight foam 21 which fills the space enclosed by the frame. Panel 20 is molded in the frame as will be described below and has a thickness substantially equal to the thickness of the vertical and horizontal support members, which is preferably at least 3 inches. The particular material selected for foam 21 should be light weight, have very good thermal insulating properties, and have sufficient strength to be self-supporting within the expanse defined between the frame members. One particularly suitable material is polyurethane foam No. CSI 8400-1.7 which is commercially manufactured by Chemelus Systems, Incorporated. Panel widths of 6–8 feet have been proven particularly suitable.

Now referring to FIG. 2, the preferred crosssectional configuration of vertical support members 12 and 14 are illustrated. Although only vertical support member 14 will be described in detail, it is to be understood that corresponding member 12 is complementary in all respects. Vertical support member 14 defines a channel 30 comprised of wall 22, web 24, flange 26, and a reentrant flange 28. This channel extends along the entire length of the vertical support member and has a generally C-shaped cross section. Apertures 16 are located along that portion of wall 22 which extends beyond reentrant flanges 28. As shown in FIG. 2, panel 20 has substantially the same width as vertical support member 14, that is approximately equal to the width of wall 22. The entire length of channel 30 is filled with foam. The foam panel 20 and the foam filling channel 30 is linked together by a passage 31 which allows communication between same. The foam filling passage 31 enables panel 20 to be securely held by the vertical support members without having to rely solely upon adhesion of the foam to these members.

Preferably the faces of panel 20 have bonded to them a thin sheet of material 32 which serves as least two purposes. First, it facilitates applying a suitable finishing material 34 such as plaster or a layer of cementitious material to the panel since the face of foam 20 presents a relatively smooth surface to which some finishing materials may not readily adhere. Secondly, sheet 32 acts as a mold release which will be described in greater detail below with regard to the method of making a panel 10. Although sheet 32 may be made of any material which adheres to both the foam 20 and the desired finished material 34, a commercially available and suitable material has been found to be a sheet of paper reinforced with wire mesh. By applying such a sheet of reinforced paper to the faces of panel 20 prior to its complete curing or setting up, the adhesiveness of the foam will securely bond the paper to the face of the foam. This reinforced paper sheet readily accepts cementitious finishing material. Of course, some finishing materials, such as wood paneling or sheets of dry wall, could be applied directly to the face of the foam.

Now referring to FIG. 3, horizontal support member 18 is shown having a similar cross-sectional configuration to that of the vertical support members. Horizontal support 18 comprises a wall 36, a web 38, a flange 40, and a reentrant flange 42. Wall 36 may form an angle with respect to horizontal corresponding to the slope of a roof which may be bolted directly to the horizontal support member by means of apertures 16. Thus, panel 10 as illustrated is suitable for a wall section used to support the eave of a roof. Those skilled in the art will also recognize that gable wall panels of similar construction can be made.

A channel 44 is defined by and extends along the longitudinal extent of horizontal support member 18 in a similar fashion to channel 30 in the vertical support members. The foam 21 which fills channel 44 is integrally linked with foam panel 20 by foam 21 which fills passage 46. Thus, the panel 20 as seen in FIG. 1 is securely attached to the vertical and horizontal support members. As shown in FIG. 3, one face of foam panel 20 has a sheet of material 32 attached to provide an interface for finishing material 34. Of course, the other face of panel 20 could have been similarly covered.

Figure 4:
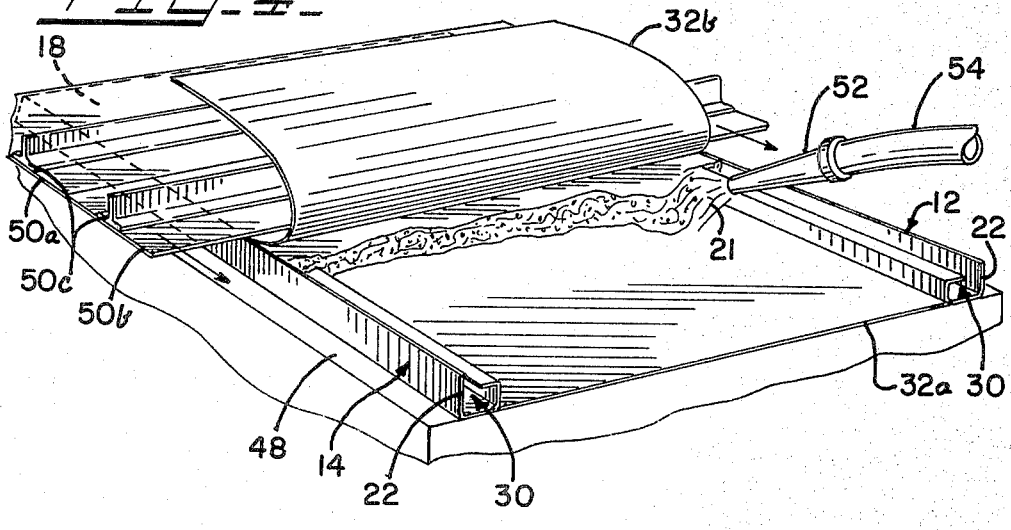
FIG. 4 is a perspective view illustrating the making of such a panel.

FIG. 4 generally depicts the manufacture of a panel in accordance with the present invention. A sheet of material **32*a* is placed upon a planar support surface 48 which is horizontally disposed. The frame consisting of horizontal support member 18 and vertical support members 12 and 14 is then placed upon sheet 32*a* which covers the area enclosed by the frame. Sheet 32*a* thus becomes the floor for receiving foam 21. Planar surface 48 functions as one-half of mold form, i.e. a mold plate. Note that the frame is positioned with passages 31 and 46 upwardly oriented to allow chambers 30 and 44** to be easily filled with foam.

A plurality of rectangular plates are used to form the other half of the mold. Mold plates **50*a* and 50*b* are shown in adjacent side-by-side relationship in FIG. 4. Initially, a sheet of material 32*b*, which is large enough to completely cover the upper surface of the frame, is placed on the frame and is supported by the edges of walls 22 of the vertical members and the edges of wall 36 of the horizontal support member 18. Thus, sheet 32*b* is supported by the perimeter of the frame. Next, mold plate 50*a* is placed across the top portion of the frame so as to captivate sheet 32*b* between its bottom surface and the edges of walls 22 and 36**.

Sheet **32*b* is then folded back over mold plate 58 similarly to that shown for plate 50*b* in FIG. 4. In this position, a mold compartment is defined by walls 22 and 36 and portions of sheets 32*a* and 32*b* adjacent to mold plate 50*a*. The width of mold plate 50*a* is narrow enough to permit foam 21 in a liquid state to be sprayed into the compartment by nozzle 51. Nozzle 52 is connected by hose 54 to a source of liquid foam under pressure. The foam 21 in a liquid state is then uniformly distributed throughout the mold forming compartment including channel 44 in horizontal support member 18 and channels 30** in the vertical support members.

Upon spraying foam 21 into the mold forming compartment, the foam in its liquid state begins almost immediately expanding. Prior to spraying foam 21 into the mold forming compartment, mold plate **50*a* has been preferably clamped in place to prevent the natural expansion of the foam from causing the plate to move upwardly. Foam 21 eventually expands to fill channels 30 and 44, and passages 31 and 46, as well as forming foam panel 20. After foam 21 has been injected into the mold compartment, sheet 32*b* is unfolded from across the top of mold plate 50*a* so as to permit mold plate 50*b* to be inserted in side-by-side adjacent relationship with the initial mold plate. Sheet 32*b* is then folded back over mold plate 50*b* as shown in FIG. 4. Similarly, mold plate 50*b* is clamped into position to prevent the expansion of the foam from causing it to move upward. Foam 21 in a liquid state is then sprayed uniformly, beginning at the last juncture of the foam which filled previous mold compartment defined by plate 50*a*, throughout the mold compartment defined by plate 50*b*. In like manner, the addition of adjacent plates and the filling of them will continue until the entire frame has been filled with foam 21. The plurality of mold forming plates are left in position until the expansion of the foam has subsided and the foam has set up at least to the extent that the mold plates may be removed without further expansion. Thus, foam panel 20 is molded under pressure. As soon as the entire foam panel 20 has thus set up or solidified, all of the mold forming plates may be removed and the frame may be removed from support surface 48** and stood in a storage position until the foam has completely hardened or cured.

The inherent characteristics of the foam is such that it naturally adheres to the sheets of material 32*a* and 32*b*, which are preferably sheets of paper reinforced with a wire mesh. In the manufacture of the foam panel, the sheets act as a mold release preventing the foam from sticking or adhering to support surface 48 and the mold plates.

Although the method for manufacturing panels embodying the current invention described above was accomplished with the frame in a generally horizontal position, it will be obvious to those skilled in the art that the method of the present invention could well be utilized with the frame in a sloped or vertical position. It is also contemplated that a single mold forming plate instead of a plurality of plates previously described could be employed. The plurality of plates were utilized merely because such plates were readily available. In some applications, it may be desirable not to fill the frame completely with foam; for example, the bottom 10 inches may not be filled so that the vertical members can be mounted in a concrete foundation.

Figure 8:
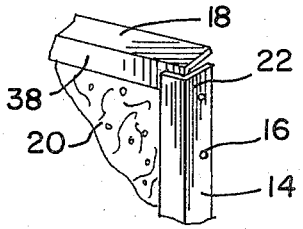
FIG. 8 is a fragmentary view illustrating an alternative attachment of the horizontal member in FIG. 1 to the vertical members.

An alternative securement of the top horizontal member to the vertical members is shown in FIG. 8. In this construction, flange 26 and reentrant flange 28 are not present at the upper ends of the vertical members so that walls 22 of the vertical members overlap the end portion of web 38 of the horizontal member with the former welded to the latter.

Figure 5:
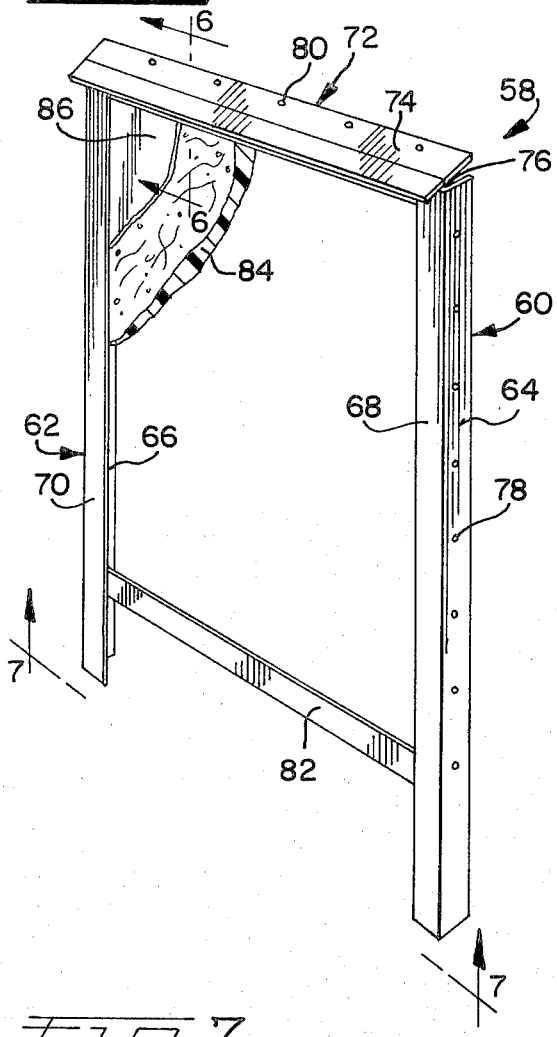
FIG. 5 is a perspective view illustrating another embodiment of the present invention.
Figure 6:
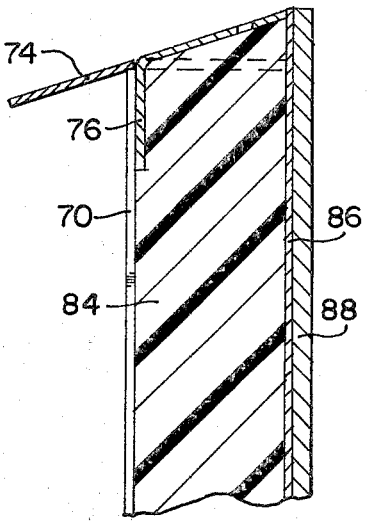
FIG. 6 is a fragmentary cross sectional view taken about line 6—6 in FIG. 5.
Figure 7:
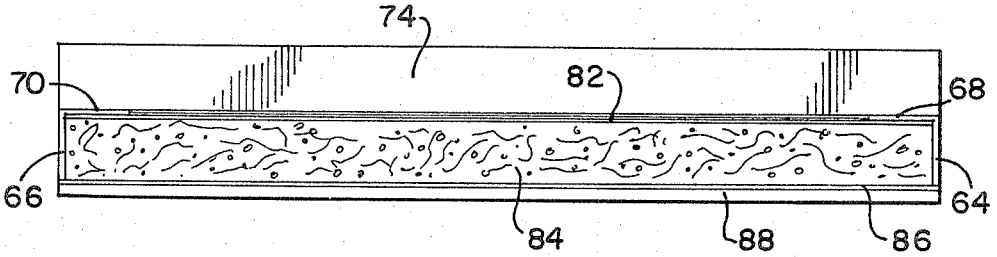
FIG. 7 is a bottom view taken about line 7—7 in FIG. 5.

Another wall panel 58 embodying this invention is shown in FIGS. 5, 6 and 7. In this embodiment, vertical members 60, 62 include walls 64, 66 which are disposed generally in parallel spaced apart relationship having inwardly projecting flanges 68, 70. Members 60, 62 are preferably lengths of conventional steel sheet metal having L-shaped cross sectional configurations. A horizontal support member 72 is attached at the upper ends of the vertical members and has a wall 74 preferably inclined to receive the eave end of a sloping roof and a downwardly projecting flange 76 extending the length of member 72 for reinforcing wall 74. This horizontal member may be likewise constructed of steel sheet metal and secured to members 60, 62 by welding overlapping portions of flange 76 to flanges 68, 70. Apertures 78 in walls 64, 66 provide a means for joining adjacent wall panels together, such as with bolts, and apertures 80 in wall 74 provide a means for joining a roof to the wall panels.

Another horizontal member 82 is preferably attached between vertical members 60 and 62 at a small distance from the lower ends of the latter, such as ten inches. This allows the lower ends of the vertical members to be easily anchored in a concrete foundation. Lower horizontal member 82 may consist of a length of steel, having a rectangular cross section, which is welded to flanges 68, 70.

Members 60, 82, 62 and 72 comprise a rectangular framework 83 which encloses a space that is filled by a rigid light-weight foam panel 84 therein. Preferably the foam panel is molded to the framework and is sufficiently adhesive in its liquid state to adhere thereto. The specific foam disclosed with respect to the previous embodiment is suitable. The flanges 68, 70 may be non-planar or may have other members or fingers extending therefrom in order to enhance the bond with the foam panel.

Like the wall panel 10 shown in FIG. 1 the structure of FIGS. 5, 6 and 7 preferably has bonded to the faces of the foam a thin sheet of material 86 that facilitates the application of a finishing material 88 such as plaster to the wall panel. Either one or both faces of the panel may be thus finished.

Wall panel 58 can be made using the same method as was used to construct wall panel 10. Preferably, the vertical members 60, 62 are disposed similar to vertical members 12, 14, viz. members 60, 62 in a generally horizontal plane resting on flanges 68, 70. Of course, the panel framework could be positioned at any desired incline to facilitate molding of the foam panel. Also, electrical conduit and pipes for plumbing can be integrated into wall panels 58.

The present invention finds particular, although not exclusive, application in the construction of homes and other structures built in accordance with the applicant's U.S. Pat. No. 4,236,361 entitled, "Prefabricated Building Components", which is incorporated herein by reference. It is contemplated that panels constructed generally in accordance with the present invention may be made with openings as illustrated therein so as to accommodate the insertion of windows and doors.

From the preceding description and drawings, it will be apparent that the panels embodying the present invention offer several advantages. Such panels are light-weight but yet strong enough to be self-supporting. The excellent thermal insulation provided will make a structure built with these panels very economical to heat and cool. The panels lend themselves to production line manufacture which makes for economical production. A significant load, such as a roof, can be supported by such panels.

Although the present invention has been described and illustrated in detail, it is to be understood that these specific embodiments and methods are offered merely by way of example and that the concept of the invention is limited in scope only by the appended claims.

What is claimed is:

1. A prefabricated load bearing wall panel for constructing the walls of a building comprising:

(a) at least two vertical support members in parallel spaced relationship, each of said vertical members including at least one longitudinal flange projecting generally inward toward the opposite vertical member;

(b) a first horizontal support member attached between the upper ends of said vertical support members, a second horizontal support member disposed parallel to said first member and secured to said vertical members, the first and second horizontal members defining a general rectangular framework enclosing a space therebetween, said second horizontal support member is secured to said vertical members intermediate the ends of the latter to define vertical legs extending beyond said framework for securing said wall panel to the building; and (c) a light-weight, rigid foam insulating panel integrally molded to said vertical support members and said flanges substantially filling the space enclosed by said framework, said foam panel comprising a liquid foam which adheres to said vertical members and said flanges, said foam solidifying to form a self-supporting panel defining first and second faces of solidified foam.

2. The prefabricated wall panel according to claim 1 further comprising apertures defined by said vertical support members for permitting adjacent wall panels to be secured to each other.

3. The prefabricated wall panel according to claim 1 wherein said vertical members have a generally L-shaped cross section.

4. The prefabricated wall panel according to claim 1 wherein said foam panel has a thickness that approximates the thickness of the vertical members.

5. The prefabricated wall panel according to claim 1 further including a sheet of material bonded to one face of said foam panel, the side of said sheet opposite said foam panel suitable to receive a cemetitious finishing material.

6. The prefabricated panel according to claim 5 wherein said sheet of material is wire reinforced paper.

7. The prefabricated panel according to claim 5 wherein said sheet is bonded to said face by the adhesiveness of said foam, said sheet applied to said face before the foam has solidified.

8. A prefabricated load bearing wall panel for constructing the walls of a building comprising:

(a) at least two vertical support members in parallel spaced relationship, each of said vertical members including at least one longitudinal flange projecting generally inward toward the opposite vertical member;

(b) a first horizontal support member attached between the upper ends of said vertical support members, a second horizontal support member disposed parallel to said first member and secured to said vertical members, the first and second horizontal members defining a general rectangular framework enclosing a space therebetween;

(c) a light-weight, rigid foam insulating panel integrally molded to said vertical support members and said flanges substantially filling the space enclosed by said framework, said foam panel comprising a liquid foam which adheres to said vertical members and said flanges, said foam solidifying to form a self-supporting panel defining first and second faces of solidified foam; and apertures defined by said first horizontal support member for permitting a roof section to be secured thereto.

9. A method for manufacturing a prefabricated load bearing wall panel for constructing the walls of a building comprising the steps of:

(a) forming a framework having two vertical support members in spaced parallel relationship secured together by first and second horizontal support members, each of said vertical members having an inwardly projecting flange;

(b) positioning two mold forming plates across said vertical members in opposing relationship enclosing at least a length of both vertical members, said mold forming plates and said vertical support members defining therebetween a mold forming compartment;

(c) injecting into said mold forming compartment foam in a liquid state which expands to fill said compartment and solidifies to form a rigid, light-weight foam panel, said foam panel adhering to the vertical support members and said flanges; and (d) removing the two mold forming plates from said frame after the foam has substantially solidified such that a foam panel is formed having self-supporting foam faces, whereby a wall panel having an integrally molded foam panel is prefabricated, (e) placing a sheet of material between said framework and one of said mold forming plates prior to step (c), said sheet not being mounted to said framework, said sheet held only by the adhesiveness of said foam to the face of the foam panel, said sheet serving as a mold releasing element to prevent said foam from adhering to said one mold framing plate.

10. The method according to claim 9 further comprising the step of applying a layer of cementitious finishing material to said sheet.

11. The method according to claim 9 wherein said mold forming compartment encloses only a portion of the space defined by said framework, further comprising the step of forming consecutive mold forming compartments along said framework, said foam injected into a compartment and allowed to substantially solidify before forming the next compartment by moving said mold forming plate, wherein the foam panel is formed in a series of sections.

12. The method according to claim 9 wherein said first and second horizontal members include a longitudinal inwardly projecting flange to which said foam adheres.

13. In a building having load bearing walls consisting of prefabricated wall panels, the improvement in said panels comprising:

(a) at least two vertical support members in parallel spaced relationship, said vertical members each including a channel;

(b) first and second spaced apart horizontal support members securely attached to said vertical support members to enclose a space therebetween, said second horizontal support member is secured at an intermediate position on said vertical support members, portions of said vertical support members extending beyond said second member defining legs for mounting said panel to said building;

(c) a light-weight, rigid foam insulating material integrally molded to said vertical support members and said channels substantially filling said space and said channels, said foam material adhering to said vertical members and said channels while the foam is in a liquid state, said foam solidifying to form a self-supporting foam panel having first and second faces made of foam.

* * * * *